US010393122B2

(12) United States Patent
Larsson et al.

(10) Patent No.: US 10,393,122 B2
(45) Date of Patent: Aug. 27, 2019

(54) METHOD FOR SHUTTING OFF A PUMP AS WELL AS PUMP STATION ARRANGEMENT

(71) Applicant: XYLEM IP MANAGEMENT S.À R.L., Senningerberg (LU)

(72) Inventors: Martin Larsson, Sundbyberg (SE); Jürgen Mökander, Sollentuna (SE); Martin Zetterquist, Solna (SE)

(73) Assignee: XYLEM EUROPE GMBH (CH)

( * ) Notice: Subject to any disclaimer, the term of this patent is extended or adjusted under 35 U.S.C. 154(b) by 273 days.

(21) Appl. No.: 15/318,841

(22) PCT Filed: Jun. 15, 2015

(86) PCT No.: PCT/IB2015/054500
§ 371 (c)(1),
(2) Date: Dec. 14, 2016

(87) PCT Pub. No.: WO2015/193784
PCT Pub. Date: Dec. 23, 2015

(65) Prior Publication Data

US 2017/0138363 A1 May 18, 2017

(30) Foreign Application Priority Data

Jun. 17, 2014 (SE) ..... 1450756

(51) Int. Cl.
*F04D 15/02* (2006.01)
*F04D 15/00* (2006.01)
(Continued)

(52) U.S. Cl.
CPC ..... *F04D 15/0066* (2013.01); *F04B 49/02* (2013.01); *F04B 49/20* (2013.01);
(Continued)

(58) Field of Classification Search
CPC .. F04D 15/02; F04D 15/0218; F04D 15/0219; F04D 15/0066; F04D 15/0083
See application file for complete search history.

(56) References Cited

U.S. PATENT DOCUMENTS 5,221,189 A 6/1993 Henningsen
5,234,319 A * 8/1993 Wilder ..... F04B 49/025 417/40

(Continued)

FOREIGN PATENT DOCUMENTS

CN 203604219 U 5/2014
EP 0696842 A1 2/1996

(Continued)

OTHER PUBLICATIONS

Singapore Written Opinion with International Search Report for Application No. 11201610485V, dated Feb. 26, 2018, 7 pages.

(Continued)

*Primary Examiner* — Patrick Hamo
(74) *Attorney, Agent, or Firm* — RatnerPrestia

(57) ABSTRACT

A pump station arrangement and a method for turning off a pump configured for pumping liquid via a conduit. The pump, before being turned off, being driven at an operational frequency ($F_N$) by a control unit. The method is characterized by the steps of, ramping down the frequency of the pump due to a turn off instruction, the terminal frequency of the ramping down being equal to the operational frequency ($F_N$) of the pump minus at least 10 Hz and the ramping down time being at least a reflection time ($T_R$) for the conduit in question, and the terminal frequency of the ramping down not being less than 10 Hz, and stopping the pump after the ramping down.

9 Claims, 3 Drawing Sheets

(51) Int. Cl.

| | |
|---|---|
| ***F04D 13/08*** | (2006.01) |
| ***F04B 49/02*** | (2006.01) |
| ***F04B 49/20*** | (2006.01) |
| ***F04D 29/18*** | (2006.01) |
| *F04D 1/00* | (2006.01) |

(52) U.S. Cl.
CPC ..... *F04D 13/086* (2013.01); *F04D 15/0083* (2013.01); *F04D 15/0218* (2013.01); *F04D 29/18* (2013.01); *F04D 1/00* (2013.01); *F05D 2270/042* (2013.01)

(56) References Cited

U.S. PATENT DOCUMENTS

| | | | | |
|---|---|---|---|---|
| 7,572,108 | B2 * | 8/2009 | Koehl | F04D 15/0088 417/53 |
| 7,612,510 | B2 * | 11/2009 | Koehl | F04D 15/0088 318/400.21 |
| 7,686,587 | B2 * | 3/2010 | Koehl | F04D 15/0088 |
| 7,704,051 | B2 * | 4/2010 | Koehl | F04D 15/0088 417/44.1 |
| 7,751,159 | B2 * | 7/2010 | Koehl | F04D 15/0088 361/33 |
| 7,755,318 | B1 * | 7/2010 | Panosh | H02P 1/42 318/778 |
| 7,815,420 | B2 * | 10/2010 | Koehl | F04D 15/0088 |
| 7,821,215 | B2 * | 10/2010 | Koehl | F04D 15/0088 318/430 |
| 7,857,600 | B2 * | 12/2010 | Koehl | F04D 15/0088 |
| 7,976,284 | B2 * | 7/2011 | Koehl | F04D 15/0088 417/42 |
| 7,983,877 | B2 * | 7/2011 | Koehl | F04D 15/0088 702/185 |
| 7,990,091 | B2 * | 8/2011 | Koehl | F04D 15/0088 318/432 |
| 8,032,256 | B1 * | 10/2011 | Wolf | E03F 5/22 137/552.7 |
| 8,436,559 | B2 * | 5/2013 | Kidd | F04B 17/03 318/34 |
| 8,444,394 | B2 * | 5/2013 | Koehl | F04D 15/0088 417/53 |
| 8,540,493 | B2 * | 9/2013 | Koehl | F04D 15/0088 417/44.11 |
| 8,641,384 | B2 * | 2/2014 | Bourell, Jr. | F04D 15/0218 417/36 |
| 8,641,385 | B2 * | 2/2014 | Koehl | F04D 15/0088 417/44.2 |
| 8,907,789 | B2 * | 12/2014 | Kochan, Jr. | F04B 41/06 340/540 |
| 9,328,727 | B2 * | 5/2016 | Koehl | F04D 15/0088 |
| 9,995,293 | B2 * | 6/2018 | Larsson | F04D 13/08 |
| 2002/0141874 | A1 | 10/2002 | Schoenmeyr | |
| 2005/0123408 | A1 * | 6/2005 | Koehl | F04D 15/0088 417/53 |
| 2010/0327790 | A1 | 12/2010 | Nolemo et al. | |
| 2011/0311370 | A1 * | 12/2011 | Sloss | F04B 47/02 417/1 |
| 2013/0022475 | A1 * | 1/2013 | Atchia | F04B 23/021 417/44.1 |

FOREIGN PATENT DOCUMENTS

| | | |
|---|---|---|
| EP | 2610501 | 7/2013 |
| JP | 5572677 | 5/1980 |
| JP | 5669486 | 6/1981 |
| JP | 2000356190 | 12/2000 |

OTHER PUBLICATIONS

International Search Report and Written Opinion for International Application No. PCT/IB2015/054500, dated Aug. 31, 2015, 8 pages.

International Preliminary Report on Patentability for International Application No. PCT/IB2015/054500, dated Jun. 3, 2016, 6 pages.

* cited by examiner

METHOD FOR SHUTTING OFF A PUMP AS WELL AS PUMP STATION ARRANGEMENT

CROSS-REFERENCE TO RELATED APPLICATIONS

This patent application is a U.S. National Phase Patent Application of PCT Application No. PCT/IB2015/054500, filed Jun. 15, 2015, which claims priority to Swedish Patent Application No. 1450756-0, filed Jun. 17, 2014, both of which are incorporated by reference herein in their entirety.

TECHNICAL FIELD OF THE INVENTION

The present invention relates in general to a method for turning off a pump that is configured to pump liquid via a conduit, the pump before being turned off being driven at an operational frequency by means of a control unit. Especially the present invention relates to a turning off method for a pump configured to pump waste water. According to a second aspect the present invention relates to a pump station arrangement comprising a pump, a control unit and a conduit connected to the outlet of the pump, which pump station arrangement is configured to perform the above mentioned turning off method.

BACKGROUND OF THE INVENTION AND PRIOR ART

In such pump station arrangements the flow rate of the liquid is in general in the range of 0.7-1 meter per second, entailing the presence of a large liquid flow having a large momentum in the conduit extending from the pump. The flow rate of the liquid is usually higher than 0.7 meter per second in order to avoid sedimentation in the conduit and does not usually exceed 1 meter per second in order not to experience to high friction losses. Thereto the conduit may be thousands of meters long. If the supply of liquid from the pump to the conduit is abruptly stopped a pressure wave in the liquid will be generated that is transported through the pipe system and thereby different parts of the liquid will have different speed. This cumbersome situation may entail the generation of vacuum bubbles in the conduit and when these implode, e.g. different parts of the liquid moving in different directions in the conduit, so-called water hammer will occur that risk damaging the conduit and its units. Thereto, when the liquid column turn back towards the pump the conventional non-return valve that is located downstream the pump will slam shut and risk to become damaged.

In order to reduce the water hammer effects it is traditionally known to ramp down the frequency of the pump from the operational frequency to zero due to an automatically of manually generated turn off instruction. The purpose of ramping down is to have the pump to generate positive pump pressure all the time and thereby keeping the non-return valve open such that the flow rate of the liquid is lowered slowly such that no vacuum bubbles are generated in the conduit. In order to entirely eliminate vacuum bubbles the ramping down has to be very long, consuming unnecessary amounts of energy.

Thereto ramping down from the operational frequency to zero entail in reality that the non-return valve will become closed despite the impeller is still driven to generate a liquid flow but the pumping pressure and/or the liquid flow is too small to manage to pump liquid into the conduit. E.g. the pump consumes energy without performing any useful output.

OBJECTS OF THE INVENTION

The present invention aims at minimizing the above mentioned drawbacks and shortages of previously known turning off methods and at providing an improved turning off method for a pump. A basic object of the invention is to provide an improved turning off method of the initially defined type, which in an as short time as possible turn the pump off at the same time as the water hammer effects in the conduit is substantially reduced.

Yet another object of the present invention is to provide a turning off method, in which the sizes of the vacuum bubbles are decreased.

It is another object of the present invention to provide a turning off method, that spares the conduit and non-return valves.

It is another object of the present invention to provide a turning off method, that entail decreased energy consumption during the turning off.

BRIEF DESCRIPTION OF THE INVENTION

According to the invention at least the basic object is attained by means of the initially defined method and pump station arrangement, having the features defined in the independent claims. Preferred embodiments of the present invention are further defined in the dependent claims.

According to a first aspect of the present invention it is provided a turning off method of the initially defined type, that is characterized by the steps of by means of the control unit ramping down the frequency of the pump due to a turn off instruction, the terminal frequency of the ramping down being equal to the operational frequency of the pump minus at least 10 Hz and the ramping down time being at least a reflection time for the conduit in question, and the terminal frequency of the ramping down not being less than 10 Hz, and by means of the control unit stopping the pump after said ramping down.

According to a second aspect of the present invention it is provided a pump station arrangement, comprising a pump, a control unit and a conduit connected to the outlet of the pump.

The pump station arrangement is characterized in that the control unit due to a turn off instruction is configured to ramp down the frequency of the pump from an operational frequency, the terminal frequency of the ramping down being equal to the operational frequency $F_N$ of the pump minus at least 10 Hz and the ramping down time being at least a reflection time $T_R$ for the conduit in question, and the terminal frequency of the ramping down not being less than 10 Hz, furthermore the control unit is configured to stop the pump after the ramping down.

Thus the present invention is based on the understanding to use the positive effects at the beginning of a ramping down and avoiding the negative effects at the end of a ramping down.

According to a preferred embodiment of the present invention, the step of stopping the pump after the ramping down, include disengagement of the pump by means of the control unit in order to let the impeller of the pump to freewheel until it stop. In this way it is ensured that the pump does not preform work that is not useful output.

According to an alternative embodiment of the present invention, the step of stopping the pump after the ramping down includes performing a second ramping down of the frequency of the pump by means of the control unit in such a way that the torque the motor of the pump is subject to from the pumped liquid is controlled towards being equal to zero. In this way an impeller freewheeling until it stop is imitated, and thereby it is ensured that the pump does not perform work that is not useful output.

According to a preferred embodiment the terminal frequency of the ramping down is less than or equal to 35 Hz, and thereto bigger than or equal to 25 Hz. In this way enough ramping down is performed in order to substantially reduce the water hammer effects without having the pump performing work that is not useful output.

Other advantages with and features of the invention are evident from the other dependent claims as well as from the following detailed description of preferred embodiments.

BRIEF DESCRIPTION OF THE DRAWINGS

A more complete understanding of the above mentioned and other features and advantages of the present invention will be evident from the following detailed description of preferred embodiments having reference to the attached drawings, in which.

DETAILED DESCRIPTION OF PREFERRED EMBODIMENTS

Figure 1:
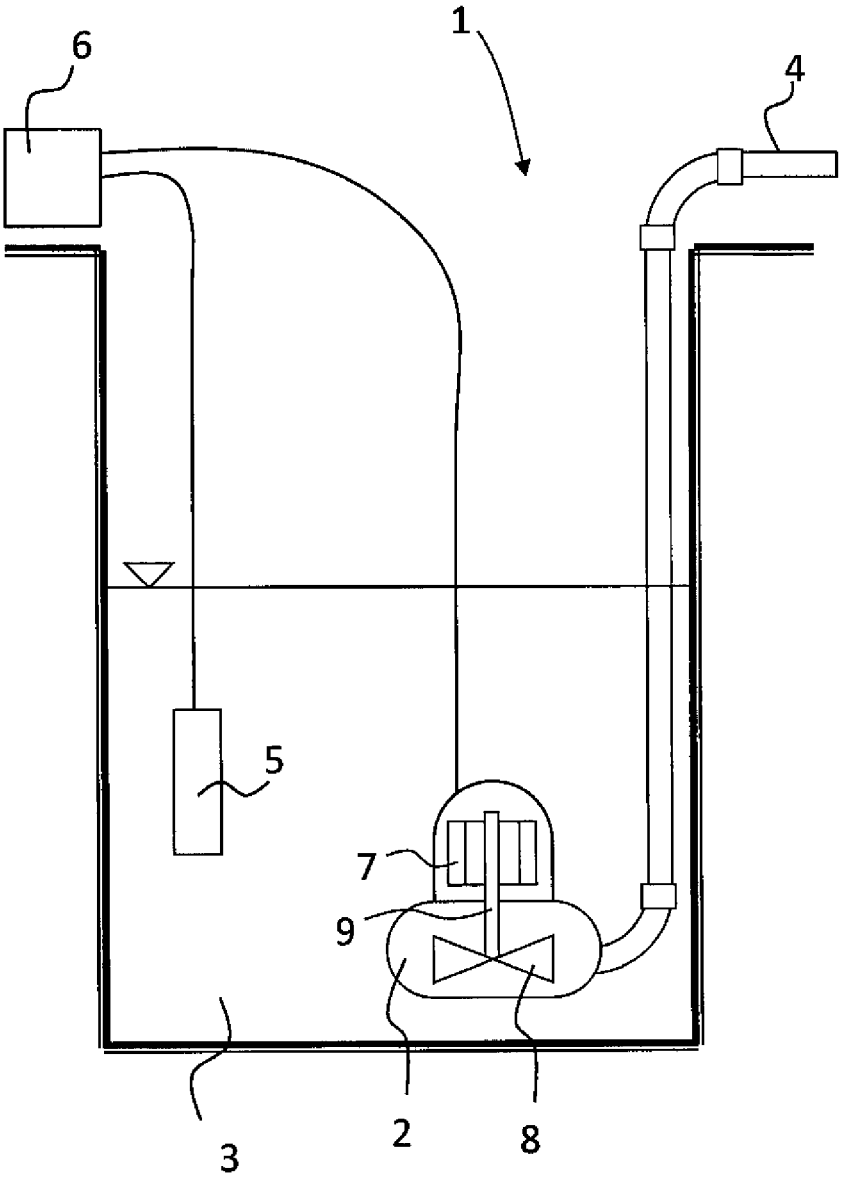
FIG. 1 is a schematic illustration of a pump station comprising the pump station arrangement.

In FIG. 1 is disclosed a pump station arrangement comprising a pump station, generally designated 1, comprising at least one speed controlled pump 2, usually two submersible pumps, configured in an active state to pump liquid from a sump 3 of the pump station 1 to a conduit 4 extending away from the pump station 1. The conduit 4 comprises a non-return valve (not disclosed) arranged in close connection with the pump 2. Thereto the pump station 1 in a conventional way comprises at least one level sensor 5 arranged to determine the liquid level in the pump station 1, the level sensor 5 may for instance be constituted by a floating level sensor that is configured to determine a predetermined liquid level or a continuous level sensor that is configured to determine different liquid levels. It shall be pointed out that the level sensor 5 may be a separate device that is operatively connected to an external control unit 6, be operatively connected to said at least one speed controlled pump 2, be built-in in said at least one speed controlled pump 2, etc. Said at lest one speed controlled pump 2 is preferably operatively connected to the external control unit 6 in order to admit adjustment of the rotational speed of the pump, alternatively said at least one speed controlled pump 2 may comprise an built-in control unit (not shown). Herein below the term control unit 6 will be used independently of its physical location.

The pump 2 and the control unit 6 together constitute at least a part of a pump arrangement, in which the pump 2 comprises an electrical motor 7 that is arranged to be driven by said control unit 6, and an impeller 8 that is connected to the motor 7 via a drive shaft 9 in a conventional way. Preferably the impeller 8 is an open impeller, and most preferably the impeller is axially displaceable in the pump 2, in relation to a suction cover/insert ring at the inlet of the pump, during operation.

The term "speed controlled" embrace all conceivable ways to change the rotational speed of the pump, or more precisely the rotational speed/operational speed of the motor 7, especially adjustment of the current feed frequency by means of a frequency converter (Variable Frequency Drive) is intended, that is built-in in a pump or that is external, and that constitutes an example of said control unit 6, the rotational speed being proportional to the current feed frequency during normal operation. However, internally or externally controlled adjustment of the supply power, etc. are intended. Thus, at an overall level of the invention it is not essential how the operational speed of the pump is regulated, only that the rotational speed of the pump 2 can be adjusted/controlled.

The pump 2 is configured to be operatively connected to the power mains that in different parts of the world have different power frequency, usually 50 Hz or 60 Hz. According to an alternative embodiment the pump 2 is operatively connected to a power generating unit that makes use of a diesel engine, or the like. The output frequency from the power generation unit may be constant or variable, and is usually 50 Hz or 60 Hz.

During normal operation of the pump 2 it is driven by means of the control unit 6 at an operational frequency $F_N$, also known as operational speed. The operational frequency $F_N$ can be varied over time of be constant, and can for instance be equal to a maximum frequency, i.e. the power frequency of the power mains, or be in the range of 90-95% of the power frequency of the power mains.

When the pump 2, or the pump station arrangement, owing to certain circumstances receive an automatically or manually generated turning off instruction, for instance from the level sensor 5, the control unit 6 initiates a controlled ramping down of the frequency F of the pump 2 from the operational frequency $F_N$ downwards. This ramping down may be linear (constant decreasing rate) or un-linear (varying decrease rate) from the operational frequency $F_N$ towards a terminal frequency for the ramping down.

Figure 2:
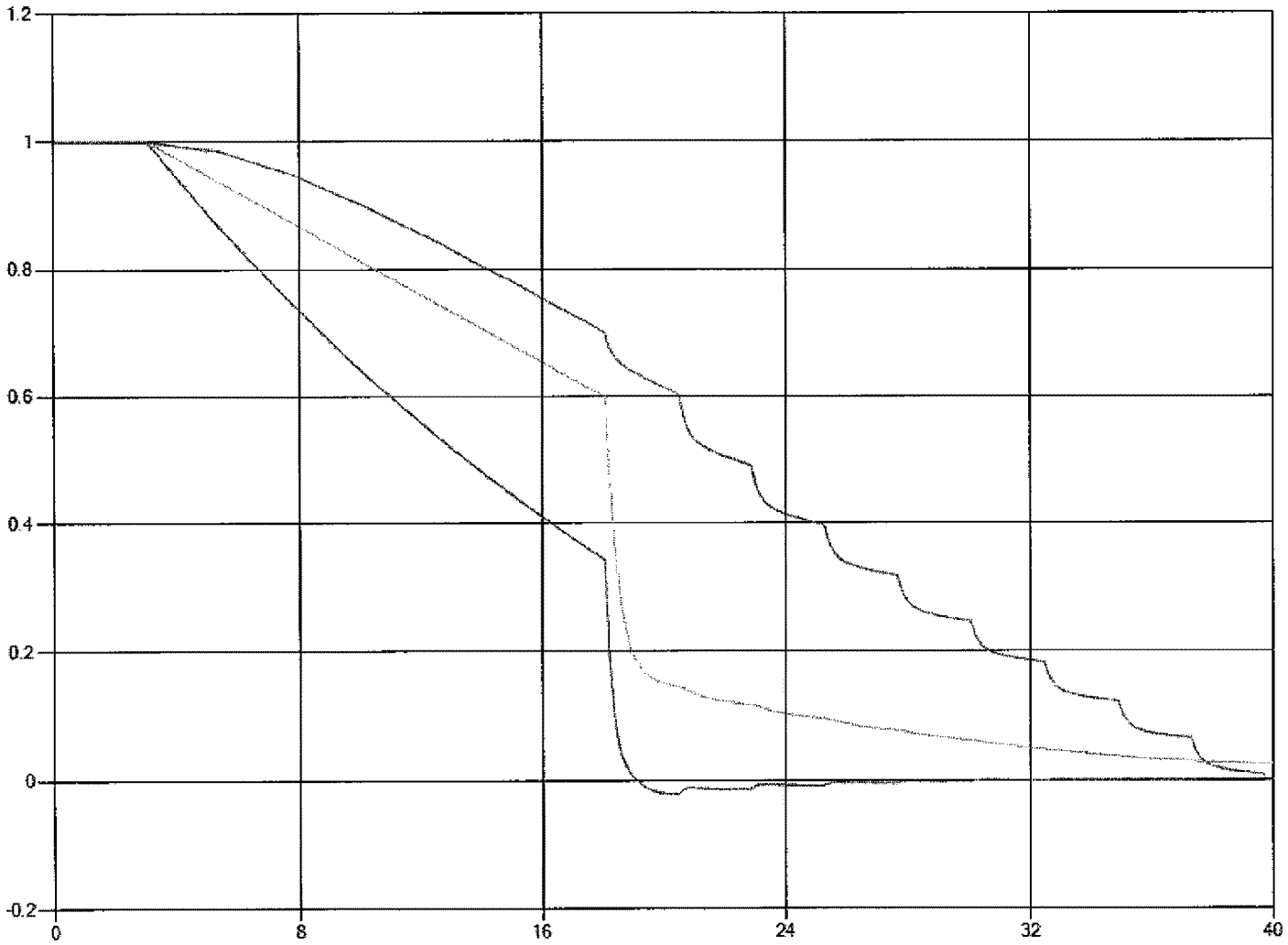
FIG. 2 is a diagram that schematically disclose how the frequency, the liquid flow and the pressure of the pump are changed during turning off in accordance with the present invention.

Reference is now made to FIG. 2 that schematically disclose a diagram having time measured in seconds at the X-axis and the frequency F of the pump 2 at the Y-axis. It shall be pointed out that the Y-axis has a comparative scale where the operational frequency $F_N$ of the pump 2 is fixed at 1 (corresponding to 100 percent, which in reality is for instance 50 Hz). The frequency F of the pump 2 is disclosed by means of the middle curve. Thereto the Y-axis also comprises the liquid flow in the conduit 4, the upper curve disclosing how the liquid flow is changed over time, and the pressure in the conduit 4 in the area downstream the pump 2, the lower curve disclosing how the pressure is changed over time. The liquid flow and the pressure are in accordance with the frequency F of the pump 2 given by means of comparative scales.

The terminal frequency of the ramping down shall be equal to the operational frequency $F_N$ of the pump 2 minus at least 10 Hz and thereto shall not fall below 10 Hz. In the embodiment disclosed in FIG. 2 the terminal frequency of the ramping down is equal to 60% of the operational frequency $F_N$, i.e. 30 Hz if the operational frequency $F_N$ is equal to 50 Hz. Preferably the terminal frequency of the ramping down shall be less than or equal to 40 Hz, or most preferably less than or equal to 35 Hz. Thereto, it is preferable that the terminal frequency of the ramping down is greater than or equal to 20 Hz, most preferably greater than or equal to 25 Hz.

The ramping down time shall be at least one reflection time $T_R$ for the conduit 4 in question. In the example disclosed in FIG. 2 the ramping down time is approximately 15 seconds.

The reflection time $T_R$ of the conduit 4 in question is known in such pump station arrangements and refer to the time it takes for a pressure wave in the conduit 4 to move back and forth in the conduit 4. The reflection time $T_R$ is equal to 2*L/C, where L is the length of the conduit and C is a material specific constant. C is in the range 300-400 if the conduit 4 is made of plastic and C is in the range 1000-1200 if the conduit 4 is made of steel. Thus, for a conduit 4 made of plastic and having a length of 2000 meter the reflection time $T_R$ is in the range 10-13 seconds, and the corresponding value for a conduit 4 made of steel is in the range 3.5-4 seconds.

According to a preferred embodiment the ramping down time shall be at least 10 seconds, most preferably at least 15 seconds. This is applicable at least when the reflection time of the conduit 4 is note known for whatever reason.

After the ramping down the inventive turning off method comprises the step of by means of the control unit 6 stop the pump 2.

According to the most preferred embodiment, that is disclosed in FIG. 2, the step of stopping the pump 2 after the ramping down includes disengagement of the pump 2 by means of the control unit 6 in order to let the impeller 8 of the pump 2 to freewheel until it stop. According to a second embodiment (not shown) the step of stopping the pump 2 after the ramping down includes performing a second ramping down of the frequency F of the pump 2 by means of the control unit 6 in such a way that the torque the motor 7 of the pump 2 is subject to from the pumped liquid is controlled towards being equal to zero. The second ramping down is terminated when the frequency F of the pump 2 is equal to zero. In other words the second embodiment implies that a freewheeling of the impeller 8 is imitated. According to a third embodiment (nor disclosed) a second ramping down may be performed that is steeper than the first ramping down.

Figure 3:
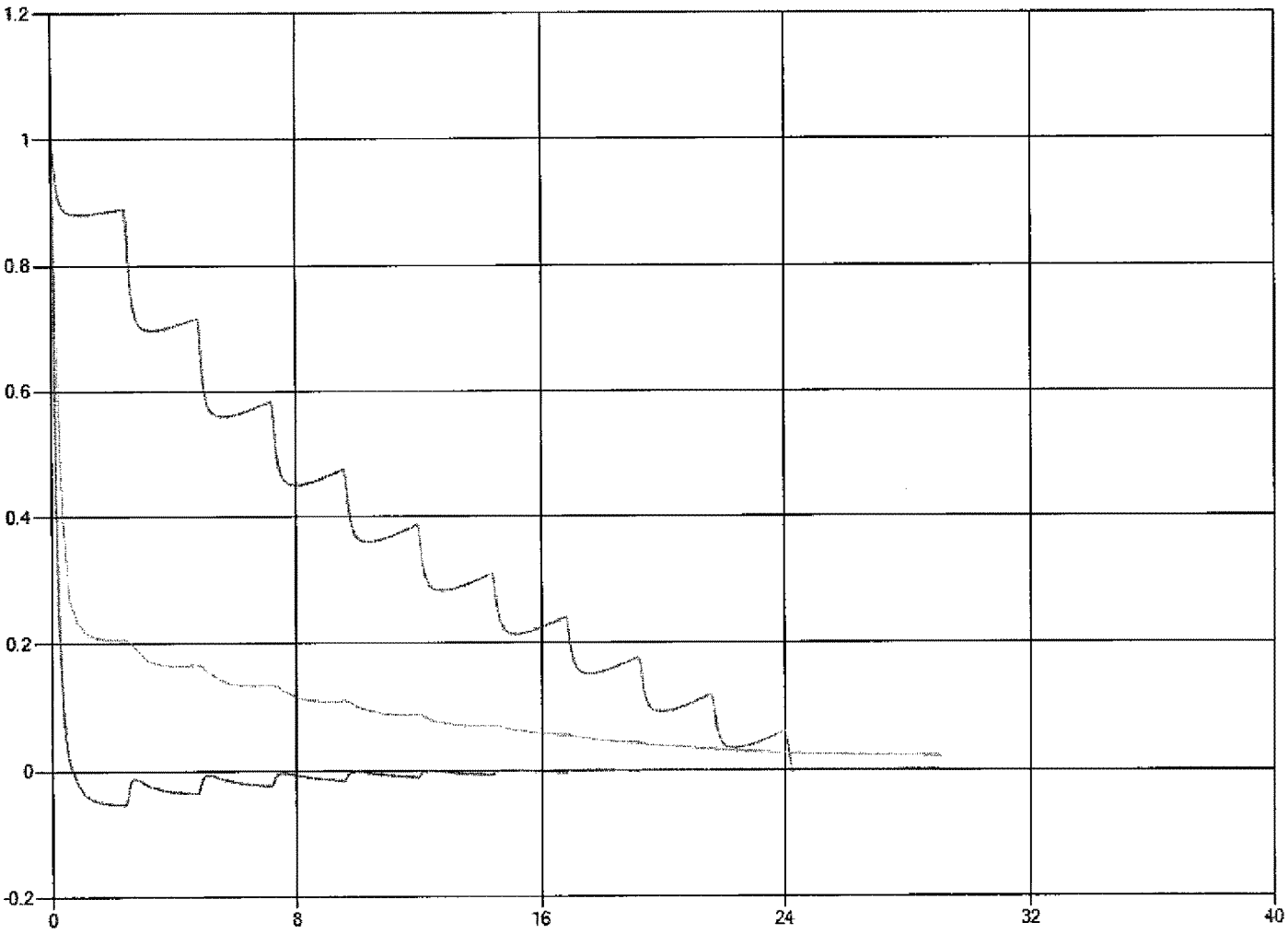
Fig. 3 Prior Art
FIG. 3 is a diagram that schematically disclose how the frequency, the liquid flow and the pressure of the pump are changed during turning off in accordance with prior art.

In FIG. 3 is disclosed a diagram of a turning off procedure according to prior art corresponding to FIG. 2, wherein the turning off of the pump 2 is performed by disengaging the impeller 8 of the pump 2 at the operational frequency and allowing the impeller 8 to freewheel until it stop. The lower curve disclose that a great under pressure arise in the conduit 4 causing extensive water hammering.

The upper curve discloses an extensive pulsation of the liquid flow in the conduit 4.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A method for turning off a pump configured for pumping liquid via a conduit, the pump before being turned off being driven at an operational frequency (FN) by a control unit, the method comprising the steps of:

ramping down a frequency of the pump using the control unit due to a turn off instruction, a terminal frequency of the ramping down being equal to the operational frequency (FN) of the pump minus at least 10 Hz and the ramping down time being at least a reflection time (TR) for the conduit, and the terminal frequency of the ramping down not being less than 10 Hz, and stopping the pump after said ramping down using the control unit, the stopping step including disengagement of the pump by the control unit in order to let an impeller of the pump to freewheel until the impeller stops.

2. The method according to claim 1, wherein the step of stopping the pump after the ramping down, includes performing a second ramping down of the frequency of the pump using the control unit in such a way that a torque the motor of the pump experiences from the pumped liquid is reduced towards zero.

3. The method according to claim 1, wherein the terminal frequency of the ramping down is less than or equal to 40 Hz.

4. The method according to claim 3, wherein the terminal frequency of the ramping down is less than or equal to 35 Hz.

5. The method according to claim 1, wherein the terminal frequency of the ramping down is greater than or equal to 20 Hz.

6. The method according to claim 5, wherein the terminal frequency of the ramping down is greater than or equal to 25 Hz.

7. The method according to claim 1, wherein the ramping down time is at least 10 seconds.

8. The method according to claim 7, wherein the ramping down time is at least 15 seconds.

9. A pump station arrangement comprising a pump, a control unit and a conduit connected to an outlet of the pump, wherein, due to a turn off instruction, the control unit is configured to ramp down a frequency of the pump from an operational frequency (FN), a terminal frequency of the ramping down being equal to the operational frequency (FN) of the pump minus at least 10 Hz and the ramping down time being at least a reflection time (TR) for the conduit, and the terminal frequency of the ramping down not being less than 10 Hz, the control unit is configured to stop the pump after the ramping down by disengagement of the pump in order to let an impeller of the pump freewheel until the impeller stops.

* * * * *